US005894264A

United States Patent [19]

Zimmermann

[11] Patent Number: 5,894,264

[45] Date of Patent: Apr. 13, 1999

[54] APPARATUS FOR GENERATING AN AUDIBLE TONE

[75] Inventor: Daniel E. Zimmermann, Peoria, Ill.

[73] Assignee: Caterpillar Inc., Peoria, Ill., IL

[21] Appl. No.: 08/896,382

[22] Filed: Jul. 18, 1997

[51] Int. Cl.[6] ..... G08B 3/00

[52] U.S. Cl. ..... 340/388.1; 340/388.4; 340/388.5

[58] Field of Search ..... 340/388.1, 388.4, 340/388.5, 388.6, 391.1, 388.3

[56] References Cited

U.S. PATENT DOCUMENTS

| | | | |
|---|---|---|---|
| 280,800 | 7/1883 | Crossley | 340/388.5 |
| 496,224 | 4/1893 | Holman | 340/388.4 |
| 752,408 | 2/1904 | O'Brien | 340/388.4 |
| 1,023,215 | 1/1912 | McGonigle | 340/388.1 |
| 1,169,038 | 1/1916 | Jones | 340/388.6 |
| 1,268,863 | 6/1918 | Manson | 340/388.5 |
| 1,474,242 | 11/1923 | Culver | 340/388.4 |
| 1,729,579 | 9/1929 | Hayes | 340/388.4 |
| 2,081,619 | 5/1937 | Ebert | 340/388.5 |
| 4,016,376 | 4/1977 | Neuhof | 340/384.73 |
| 4,075,626 | 2/1978 | Sakaguchi et al. | 340/388 |
| 4,090,041 | 5/1978 | Mori et al. | 179/115 |
| 4,134,200 | 1/1979 | Frigo | 29/594 |
| 4,374,624 | 2/1983 | Murata | 368/250 |
| 4,391,532 | 7/1983 | Hara | 368/250 |
| 4,418,247 | 11/1983 | Hansen | 179/115.5 |
| 4,615,105 | 10/1986 | Wada et al. | 29/594 |
| 4,813,123 | 3/1989 | Wilson et al. | 29/593 |
| 5,111,510 | 5/1992 | Mitobe | 381/193 |
| 5,521,886 | 5/1996 | Hirosawa et al. | 367/174 |
| 5,590,210 | 12/1996 | Matsuo et al. | 381/199 |
| 5,625,700 | 4/1997 | Sone | 381/192 |

FOREIGN PATENT DOCUMENTS

| | | | |
|---|---|---|---|
| 93366 | 6/1923 | Germany | 340/388.3 |
| 375994 | 7/1932 | United Kingdom | 340/388.4 |

*Primary Examiner*—Nina Tong

*Attorney, Agent, or Firm*—Mario J. Donato, Jr.

[57] ABSTRACT

An apparatus for generating a audible tone is disclosed. The apparatus includes a non-ferromagnetic container 105, a ferromagnetic member 110, a coil 115, a first stationary lead wire 175, a second stationary lead wire 180, and a flexible ferromagnetic diaphragm 120. The ferromagnetic member 110 is essentially disposed within the nonferromagnetic container 105. The coil 115 is encircling a portion of the ferromagnetic member 110. The coil 115 has an input end 165 connected to a first stationary lead wire 175, configured to receive an electrical signal, and an output end 170 connected to a second stationary lead wire 180. The flexible ferromagnetic diaphragm 120 is disposed along the top edge 135 of the non-ferromagnetic container 105. The flexible ferromagnetic diaphragm 120 is configured to flex when magnetically attracted toward the ferromagnetic member 110. As the flexible ferromagnetic diaphragm 120 flexes the first stationary lead wire 175 and the second stationary lead wire 180 will remain stationary.

2 Claims, 3 Drawing Sheets

PRIOR ART 100
175
150
155
180
120
135
130
145
190
185
195a
195b
140
105
125
165
110
115
160
170

APPARATUS FOR GENERATING AN AUDIBLE TONE

TECHNICAL FIELD

This invention relates generally to an apparatus for generating an audible tone and more particularly to a noise generating transducer associated with an alarm device.

BACKGROUND ART

Noise generating transducers are used for converting an input electrical signal to an output audible tone. Currently, noise generating transducers are used in the alarm devices of various types of machines and vehicles. Earth moving machines, utility vehicles, garbage trucks, and school buses are all examples of machines or vehicles that may use an alarm device. Alarm devices are typically used to warn people in the surrounding area that a machine or a vehicle is moving, such as in a backward motion.

An alarm device having a conventional noise generating transducer with an attached moving coil type of diaphragm is shown in FIG. 1, as an example. The diaphragm 10 is typically made of a rigid plastic material in the shape of a spherical dome. Along the circumference of the diaphragm 10 is a corrugated ring like structure 15. The corrugated ring like structure 15 is designed to expand and contract, allowing the diaphragm 10 to move. The moving coil 20, is attached to the diaphragm 10. Flexing wire leads 25*a–b*, connected to each end of the attached moving coil 20, are used to input and output an electrical signal. The attached moving coil 20 and the flexing wire leads 25*a–b* are typically made of a braided copper wire.

The conventional noise generating transducer 5 includes a ceramic ring permanent magnet 30 located radially around the inside rim of the transducer housing 35. A first magnetic member 40 is also located radially around the inside rim of the transducer housing 35, and a second magnetic member 45 is located near the center of the transducer housing 35 and beneath the diaphragm 10. A gap between the top of the second magnetic member 45 and the diaphragm 10 allows the diaphragm 10 to move.

A mechanical force on the attached moving coil 20 is produced by the interaction of the current, from an electrical signal input, to the attached moving coil 20 and the magnetic field disposed radially across the gap between the first magnetic member 40 and the second magnetic member 45. An audible tone is produced by the oscillating movement of the diaphragm 10.

However, with the moving diaphragm type of alarm device, problems with the flexing wire leads 25*a–b* may occur. Due to the flexing wire leads 25*a–b* being connected to each end of the attached moving coil 20, the flexing wire leads 25*a–b* have to move with the oscillation of the diaphragm 10. The point of connection between the flexing wire leads 25*a–b* and the attached moving coil 20 may sever due to the stress placed on the connection by the movement. Also, a crimp may form in the flexing wire leads 25*a–b* due to the flexing wire leads 25*a–b* being forced to move with the oscillating movement of the diaphragm 10. The crimp may eventually lead to a breakage of the flexing wire leads 25*a–b*.

The present invention is directed to overcoming one or more of the problems as set forth above.

DISCLOSURE OF THE INVENTION

In one aspect of the present invention, an apparatus for generating an audible tone in an alarm device is disclosed.

The alarm device includes a noise generating transducer. The noise generating transducer includes a non-ferromagnetic container, a ferromagnetic member, a coil, a first stationary lead wire, a second stationary lead wire, and a flexible ferromagnetic diaphragm. The non-ferromagnetic container includes a substantially annular bottom plate and a continuous side. The continuous side has a bottom edge and a top edge. The bottom edge of the continuous side is disposed along the perimeter of the substantially annular bottom plate defining a cavity therein. The ferromagnetic member is disposed within the cavity. The ferromagnetic member has a first end pole and a second end pole. Between the first end pole and the second end pole is a base. The base is located proximal to the substantially annular bottom plate. The coil is encircling a portion of the ferromagnetic member. The coil has an input end, and an output end. The first stationary lead wire is connected to the input end, and the second stationary lead wire is connected to the output end. The flexible ferromagnetic diaphragm is disposed along the top edge of the continuous side, essentially enclosing the cavity. The flexible ferromagnetic diaphragm is configured to flex when magnetically attracted toward the ferromagnetic member.

These and other aspects and advantages of the present invention, as defined by the appended claims, will be apparent to those skilled in the art from reading the following specification in conjunction with the drawings and the claims.

BRIEF DESCRIPTION OF THE DRAWINGS

For a better understanding of the invention, reference may be made to the accompanying drawings, in which.

BEST MODE FOR CARRYING OUT THE INVENTION

Figure 1:
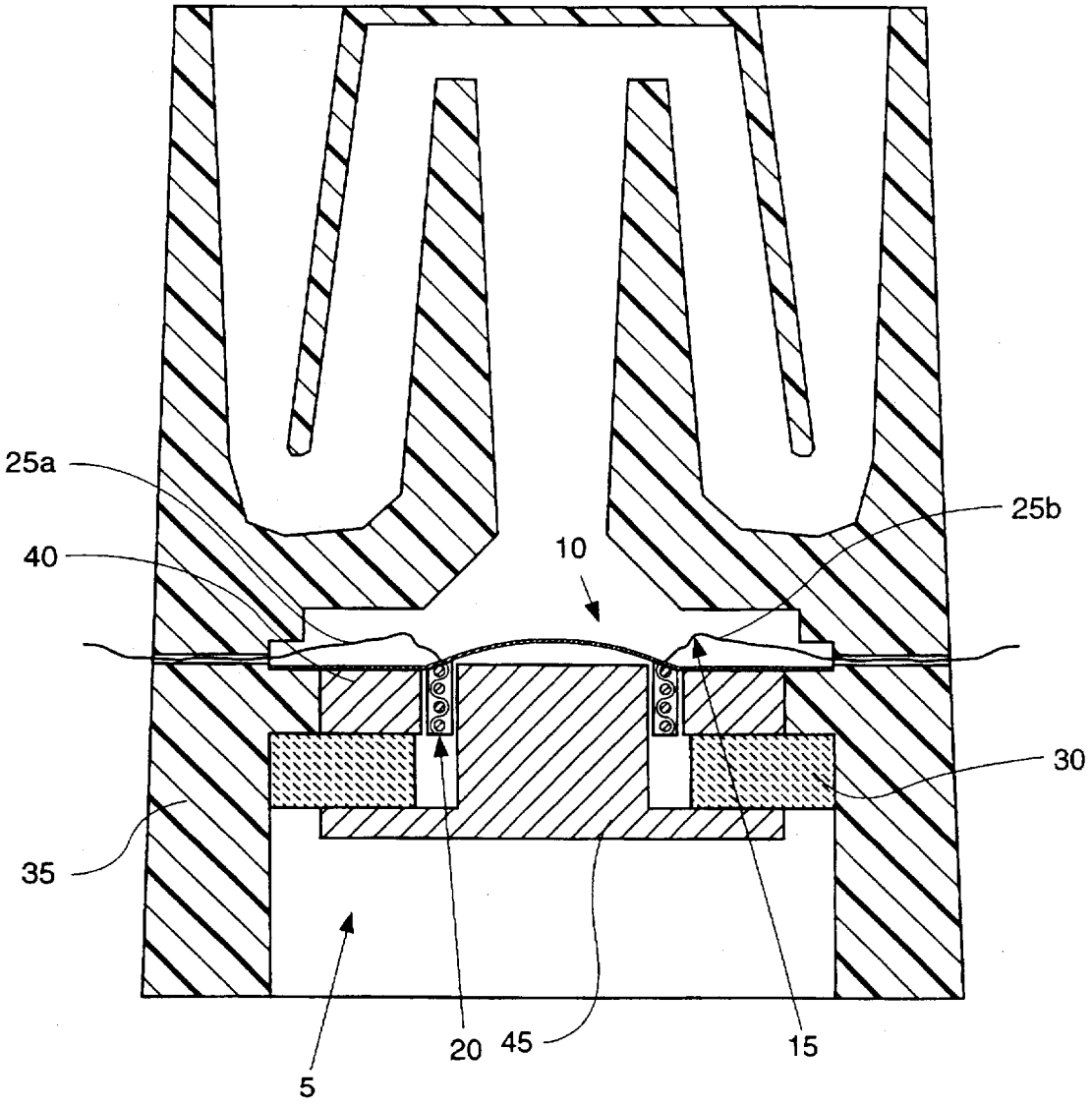
FIG. 1 is a cross-sectional view illustrating a conventional noise generating transducer.
Figure 2:
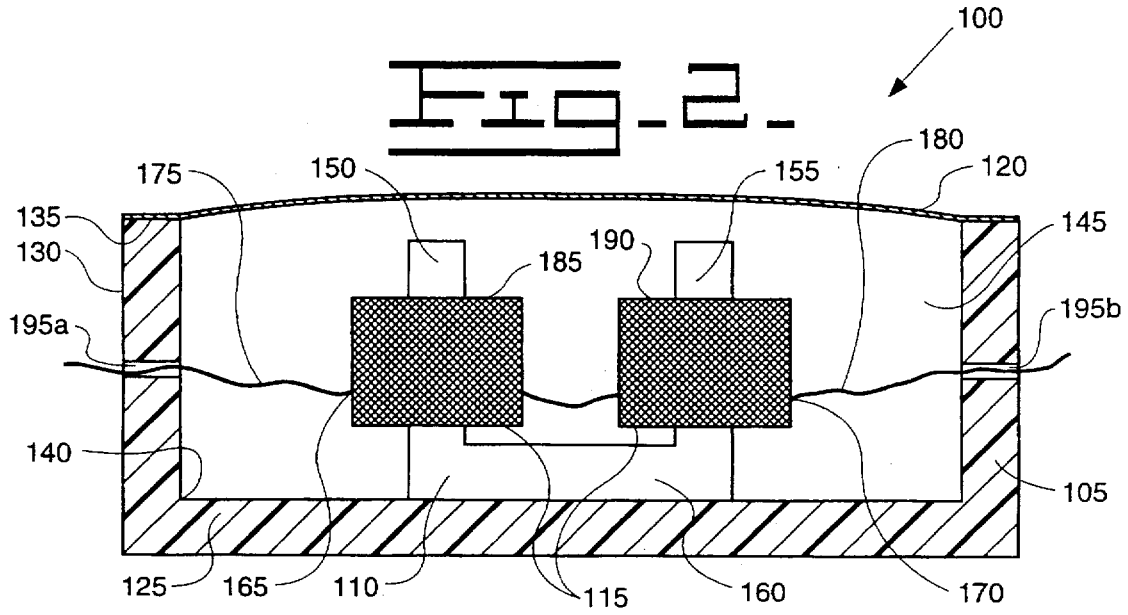
FIG. 2 is a cross-sectional view illustrating a preferred embodiment of the noise generating transducer of the present invention.

Referring to FIG. 2, a cross-sectional view illustrating a preferred embodiment of the noise generating transducer is shown. The noise generating transducer 100 includes a non-ferromagnetic container 105, a ferromagnetic member 110, a coil 115, and a flexible ferromagnetic diaphragm 120.

The non-ferromagnetic container 105 is comprised of a substantially annular bottom plate 125 and a continuous side 130. The continuous side 130 includes a top edge 135 and a bottom edge 140. The bottom edge 140 is disposed along the perimeter of the substantially annular bottom plate 125 defining a cavity 145 therein. The flexible ferromagnetic diaphragm 120 is disposed along the top edge 135 of the non-ferromagnetic container 105 substantially enclosing the cavity 145. In the preferred embodiment, the flexible ferromagnetic diaphragm 120 is composed of a dome shaped thin soft-iron that is case hardened to produce a high degree of elasticity. However, one skilled in the art can readily implement the present invention in connection with a flexible ferromagnetic diaphragm 120 having a flat shape or being composed of any type of flexible ferromagnetic material.

The ferromagnetic member 110 is composed of a ferromagnetic material, having a first end pole 150, a second end pole 155, and a base 160. The base 160 is located between the first end pole 150 and the second end pole 155. In the preferred embodiment, the ferromagnetic member 110 is substantially U-shaped, with the base 160 being the bottom portion of the U-shape. The first end pole 150 and the second end pole 155 are the side portions of the U-shape. Although the preferred embodiment is discussed with respect to the ferromagnetic member 110 having a U-shape, one skilled in the art could readily implement the present invention in connection with the ferromagnetic member 110 having a different shape, such as a V-shape, or a straight-shape. The ferromagnetic member 110 is located inside the cavity 145 wherein the base 160 is proximal to the substantially annular bottom plate 125.

The coil 115 is encircling a portion of the ferromagnetic member 110. The coil 115 has an input end 165 and an output end 170. A first stationary lead wire 175 is connected to the input end 165 of the coil 115. A second stationary lead wire 180 is connected to the output end 170 of the coil 115. At least one of an orifice 195 a–b, located in the non-ferromagnetic container 105, is configured to allow passage of the first stationary lead wire 175 and the second stationary lead wire 180.

In the preferred embodiment, the coil is composed of a first section 185 and a second section 190 wherein the first section 185 is encircling a portion of the first end pole 150, and the second section 190 is encircling a portion of the second end pole 155. The input end 165 of the coil 115 is located on the first section 185, and the output end 170 of the coil 115 is located on the second section 190.

Figure 3:
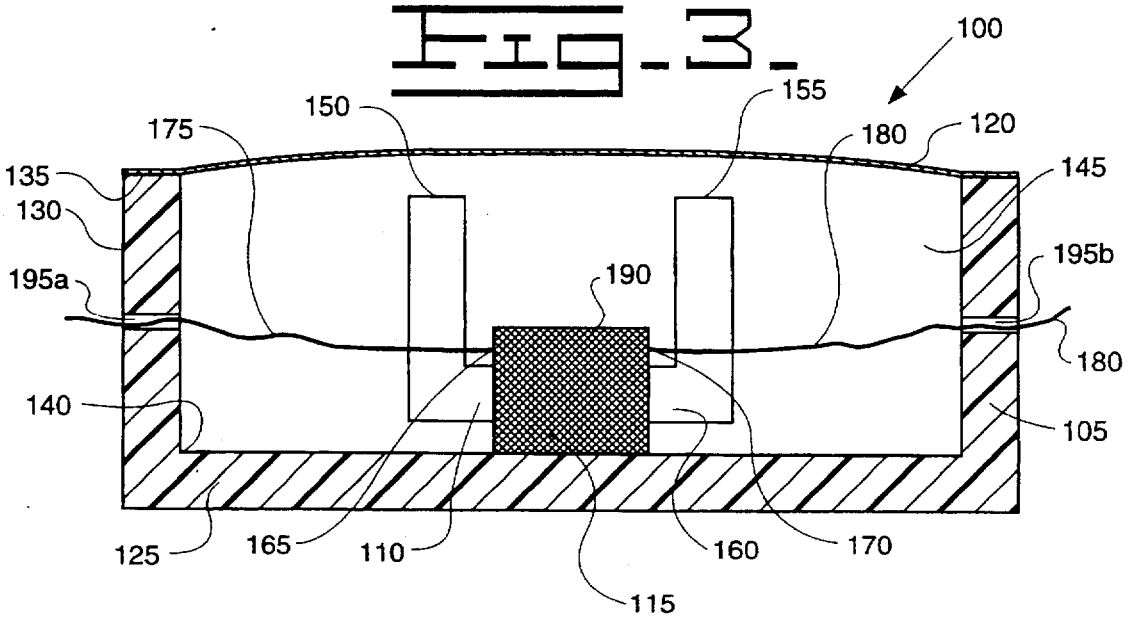
FIG. 3 is a cross-sectional view illustrating another embodiment of the noise generating transducer, including a different embodiment for the coil location, of the present invention.

Referring to FIG. 3, a cross-sectional view illustrating another embodiment of the noise generating transducer 100 is shown. The coil 115 is encircling a portion of the base 160 of the ferromagnetic member 110.

Figure 4:
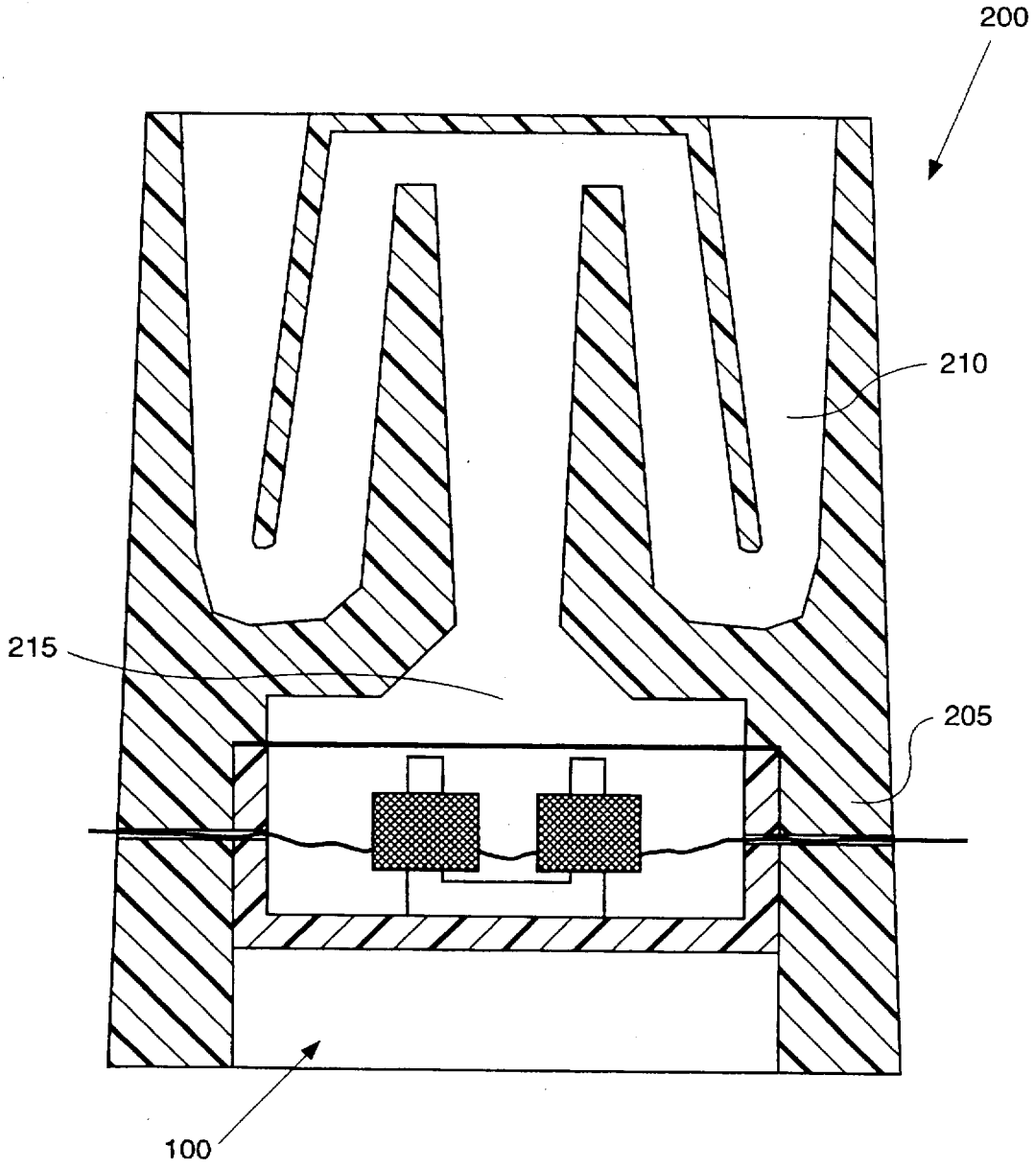
FIG. 4 is a cross-sectional view illustrating an alarm device including a noise generating transducer and a horn.

Referring to FIG. 4, a cross-sectional view illustrating an alarm device is shown. The alarm device 200 includes an alarm housing 205, the noise generating transducer 100, and a horn 210. The alarm housing 205 is configured to hold the noise generating transducer 100, and the horn 210. The horn 210 has a horn diaphragm end 215 located a predetermined distance from the flexible ferromagnetic diaphragm 120. In the preferred embodiment, the horn 210 is a folded horn type well known in the art.

When an electrical signal is applied to the first stationary lead wire 175 an electromagnet is produced from the interaction of the current through the coil 115 and the magnetic field disposed across the distance between the first end pole 150 and the second end pole 155. The second stationary lead wire 180 is used to complete the electrical circuit. The flexible ferromagnetic diaphragm 120 is configured to flex when magnetically attracted toward the ferromagnetic member 110. As the flexible ferromagnetic diaphragm 120 flexes the first stationary lead wire 175 and the second stationary lead wire 180 will remain stationary.

In the preferred embodiment, the electrical signal is a pulse signal. The electromagnet will be turned on and off with the rising and falling of the pulse signal. The flexible ferromagnetic diaphragm 120 will oscillate as the electromagnet is turned on and off, thereby producing an audible sound. The horn 210 will amplify the noise, creating an alarm type noise. Although, the preferred embodiment is discussed with respect to the electrical signal being a pulse signal, one skilled in the art could readily implement the present invention in connection with the electrical signal being another type of signal, such as, a sinusoidal signal or a ramp signal.

INDUSTRIAL APPLICABILITY

The alarm type noise, produced by the alarm device 200, is typically used as a warning signal on various types of machines and vehicles. For example, earth moving machines are typically large machines with a single operator. Due to the size and shape of the machine, the operator may be unable to see what is within a few feet of the machine. An alarm device 200, located on the earth moving machine, can be configured to produce an alarm type noise in the form of a warning signal whenever the earth moving machine is backing up. In this situation, the warning signal is used to alert people within the surrounding area that the earth moving machine is backing up.

What is claimed is:

1. An apparatus for generating an audible tone in an alarm device, comprising:

a non-ferromagnetic container, said non-ferromagnetic container including a substantially annular bottom plate, said non-ferromagnetic container including a continuous side, said continuous side having a bottom edge disposed along the perimeter of the substantially annular bottom plate defining a cavity therein, and said continuous side having a top edge;

a ferromagnetic member, said ferromagnetic member being disposed within said cavity, said ferromagnetic member having a first end pole, said ferromagnetic member having a second end pole, said ferromagnetic member having a base located between said first end pole and said second end pole, and said base being located proximal to said substantially annular bottom plate;

a coil, said coil encircling a portion of said ferromagnetic member, said coil having an input end, and said coil having an output end;

a first lead wire, said first lead wire being connected to said input end of said coil, and said lead wire being configured to deliver an electrical signal to said coil;

a second lead wire, said second lead wire being connected to said output end of said coil, and said second lead wire being configured to output said electrical signal from said coil;

an orifice defined in said non-ferromagnetic container, said orifice being configured for passage of at one of said first lead wire and said second lead wire;

a flexible ferromagnetic diaphragm, said flexible ferromagnetic diaphragm being disposed along said top edge of said continuous side essentially enclosing said cavity, said ferromagnetic diaphragm being configured to flex when magnetically attracted toward said ferromagnetic member;

a horn, said horn having a diaphragm end, and said diaphragm end of said horn being located a predetermined distance from said flexible ferromagnetic diaphragm, an alarm housing, said alarm housing being configured to hold at least one of the said non-ferromagnetic container and said flexible ferromagnetic diaphragm and said horn.

2. An apparatus as set forth in claim 1 including said coil having a first section and a second section, said first section and said second section being substantially the same size, said input end of said coil being located on said first section, said output end of said coil being located on said second section, said first section of said coil encircling a portion of said first end pole, and said second section of said coil encircling a portion of said second end pole.

* * * * *

UNITED STATES PATENT AND TRADEMARK OFFICE

CERTIFICATE OF CORRECTION

PATENT NO. : 5,894,264

DATED : April 13, 1999

INVENTOR(S) : Daniel E. Zimmermann

It is certified that error appears in the above-identified patent and that said Letters Patent is hereby corrected as shown below:

correct Claim 1 as follows:

Column 4, line 42, insert --least-- after "at"

Signed and Sealed this

Fourteenth Day of September, 1999

*Attest:*

Q. TODD DICKINSON

*Attesting Officer*

*Acting Commissioner of Patents and Trademarks*